US005405280A

United States Patent [19]

Polikarpus et al.

[11] Patent Number: 5,405,280

[45] Date of Patent: Apr. 11, 1995

[54] INTEGRATED MOLDING AND INKING PROCESS FOR FORMING A TORCH JET SPARK PLUG

[75] Inventors: Kaius K. Polikarpus, Davison; Harold E. Durling, Elsie, both of Mich.

[73] Assignee: General Motors Corporation, Detroit, Mich.

[21] Appl. No.: 202,624

[22] Filed: Feb. 28, 1994

[51] Int. Cl.[6] ..... H01T 13/20

[52] U.S. Cl. ..... 445/7; 264/61; 419/10

[58] Field of Search ..... 445/7; 419/10; 264/61, 264/60

[56] References Cited

U.S. PATENT DOCUMENTS

| | | | |
|---|---|---|---|
| 3,004,197 | 10/1961 | Rodriguez et al. | 264/61 |
| 3,074,143 | 1/1963 | Smith | 264/61 |
| 4,097,977 | 7/1978 | Pollner | 445/7 |
| 4,655,984 | 4/1987 | Hinton | 445/7 |
| 5,210,458 | 5/1993 | McDougal | 313/130 |
| 5,245,963 | 9/1993 | Sabol et al. | 123/266 |

FOREIGN PATENT DOCUMENTS

| | | | |
|---|---|---|---|
| 714507 | 2/1980 | U.S.S.R. | 264/61 |

*Primary Examiner*—P. Austin Bradley
*Assistant Examiner*—Jeffrey T. Knapp
*Attorney, Agent, or Firm*—Charles K. Veenstra

[57] ABSTRACT

A method is provided for forming a torch jet spark plug suitable for use in a torch jet-assisted spark ignition system for an internal combustion engine. The torch jet spark plug is configured to ignite a fuel mixture within a combustion prechamber formed integrally within the insulator body of the spark plug, such that a jet emanates from the prechamber and projects into the main combustion chamber of the engine, so as to increase the burning rate within the main chamber. More particularly, the method involves forming a tubular inner electrode on the internal surface of the combustion prechamber by integrating the molding process for the spark plug's insulator body with an inking process by which the inner electrode is formed.

18 Claims, 2 Drawing Sheets

INTEGRATED MOLDING AND INKING PROCESS FOR FORMING A TORCH JET SPARK PLUG

The present invention generally relates to spark plugs of the type for torch jet-assisted spark ignition of an air/fuel mixture within a combustion chamber of an internal combustion engine, wherein ignition of an air/fuel mixture within a combustion prechamber creates a torch jet that increases the burning rate of the air/fuel mixture within the combustion chamber. In particular, this invention relates to a method for forming such a torch jet spark plug, wherein a metallic ink is transferred to an isostatically pressed powder compact which is subsequently fired to form an insulator body for the spark plug.

BACKGROUND OF THE INVENTION

Spark ignition of an air/fuel mixture within a combustion chamber of an internal combustion engine generally involves igniting the air/fuel mixture with an electric spark jumped between an electrode and a ground electrode of a spark plug. An alternative to spark ignition known in the art is torch jet-assisted spark ignition which, as taught by U.S. Pat. Nos. 3,921,605 to Wyczalek and 4,924,829 to Cheng et al., offers several advantages over spark ignition approaches. As the name suggests, torch jet-assisted spark ignition utilizes a jet of burning gases which is propelled into the combustion chamber in order to increase the burning rate within the combustion chamber by providing increased turbulence as well as presenting a larger flame front area. As a result of a faster burning rate, lower cyclic variation in cylinder pressure is achieved, which enables a higher engine efficiency with a higher compression ratio.

In a torch jet-assisted spark ignition system, the jet typically emanates from a combustion prechamber, and passes through an orifice into the main combustion chamber. Though an air/fuel mixture can be introduced directly into the prechamber through a separate intake valve or fuel injector, it is generally preferable that the air/fuel mixture originate from the main chamber in order to simplify the construction of the engine and its ignition system. Furthermore, combustion of the air/fuel mixture within the prechamber can be initiated from within by a separate igniter, or can be initiated by the flame front within the main chamber. With either approach, combustion typically proceeds relatively simultaneously in both the prechamber and the main chamber. However, because of the small relative volume of the prechamber, a high pressure is developed in the prechamber while the pressure is still relatively low in the main chamber. As a result, a jet of burning gases shoots from the prechamber far into the main chamber, and thereby significantly increases the combustion rate in the main chamber.

A torch jet spark plug taught by copending U.S. patent application (Attorney Docket No. G-11389) to Durling et al., assigned to the assignee of this invention, offers particularly advantageous features which enhance performance as well as manufacturability. One improvement is a greater resistance to pre-ignition within the prechamber at high operating temperatures. In particular, the spark plug employs a pair of inner electrodes which form a radial spark gap within the prechamber. The inner electrodes are positioned within the prechamber so as to be spaced away from the engine's combustion chamber. Furthermore, the spark plug's construction provides for intimate thermal contact between the inner electrodes and the body of the spark plug, so as to promote thermal conduction therebetween, which further minimizes the inner electrodes' operating temperature, and thereby reduces the likelihood of preignition. The spark plug taught by Durling et al. is also advantageous in that it substantially eliminates the potential for internal short circuits to ground within the spark plug as a result of deposits building up on the internal surface of the prechamber.

Durling et al. achieve the above advantages by forming within the insulator body of the spark plug a combustion prechamber on whose surface an inner electrode is formed. The prechamber has a first end and an oppositely disposed second end which are preferably disposed along the longitudinal axis of the insulator body. An orifice is formed in the insulator body at the second end of the prechamber such that, when the spark plug is properly installed in an engine, the prechamber is vented to the engine's main combustion chamber through the orifice. A center electrode is mounted in the insulator body so as to project into the first end of the prechamber, while an outer electrode is formed integrally with the orifice at the second end of the prechamber. A ground electrode is disposed adjacent the outer electrode so as to define an outer spark gap therewith.

A metal ink, preferably a catalytically-active metal such as platinum suspended in a suitable carrier, is deposited on the internal surface of the prechamber to form the inner electrode. The inner electrode circumscribes the center electrode so as to form an inner radial spark gap therewith. The inner electrode is also in electrical contact with the outer electrode, so as to be able to deliver an electric current from the center electrode to the outer electrode. In one embodiment, the metal ink is deposited as a longitudinal stripe along the inner surface of the prechamber, while in another embodiment, the metal ink is deposited on substantially the entire longitudinal surfaces of the prechamber as well as the rim of the orifice, so as to simultaneously form a hollow inner electrode and a hollow outer electrode. With both embodiments, the inner electrode forms an electrical capacitor with the spark plug's metal shell and the insulator body positioned between the inner electrode and the metal shell. The greater electrode surface area provided by the inner electrode of the second embodiment serves to enhance the capacitive effect. As a result of capacitive charging, the electric sparks which occur at the inner radial spark gap and the outer spark gap will fire sequentially rather than simultaneously, so as to reduce the peak voltage levels required to fire the spark plug. Accordingly, the electrical demands placed on the ignition coil and wiring will also be reduced.

While the structure taught by Durling et al. is advantageous for the reasons noted above, depositing the metal ink on the interior surface of a relatively small prechamber is difficult. In addition, depositing the metal ink after the insulator body and its prechamber have been formed and fired necessitates that two heating steps be performed—a first to fire the "green" ceramic blank from which the insulator body is formed, and a second to dissipate the carrier component of the metal ink and sinter the metal ink. Finally, with the above technique, the metal ink does not significantly penetrate the ceramic blank, such that the resulting inner electrode is susceptible to erosion from the hot gases within the prechamber. Confronted with a somewhat different problem, U.S. Pat. No. 5,210,458 to McDougal discloses a method by which an electrically conductive path can be formed through a solid dielectric material, such as a center electrode in a spark plug insulator body, using a cermet ink. However, McDougal teaches a technique in which the cermet ink is introduced into a mass of ceramic powder which is under a continuous compressive force, such that the ceramic powder inherently collapses about the cermet ink, thereby forming a solid electrode running through the body formed from the ceramic powder. In contrast, the inner electrode utilized in the spark plug taught by Durling et al. is disposed on the internal surface of a prechamber within the insulator body of the spark plug. Accordingly, the inner electrode taught by Durling et al. cannot be formed in accordance with the teachings of McDougal.

The method taught by McDougal involves applying the cermet ink to a spindle which is then inserted into a rubber mold containing granulated ceramic material. To prevent removal of the cermet ink during insertion, McDougal uses a flash drying operation to dry the cermet ink on the spindle. While the above approach may be suitable when the object is to form a discrete mass of conductor material within a ceramic body, as is the goal of McDougal, it has been determined that a dried ink will not transfer well to the ceramic material using certain molding techniques. More specifically, when forming an electrode on a surface, as taught by Durling et al., it is highly desirable that the ink impregnate the ceramic material so as to become substantially integral with the ceramic material, such that a strong bond between the electrode and the ceramic material is created. The method taught by McDougal cannot reliably achieve this desirable result. In addition, the method taught by McDougal requires pressure to be maintained as the spindle is removed from the mold in order to effectively remove the cermet ink from the spindle, a requirement which somewhat complicates the molding process. Furthermore, the use of an additional operation to flash dry the ink on the spindle is disadvantageous from a manufacturing standpoint.

Therefore, what is needed is a method for forming an inner electrode on the internal surface of a chamber within the insulator body of a torch jet spark plug, wherein the method is relatively uncomplicated and necessitates a minimal number of operations, so as to be suitable for use in the mass production of torch jet spark plugs for an internal combustion engine.

SUMMARY OF THE INVENTION

It is an object of this invention to provide a method for forming a spark plug that is configured to produce a jet for increasing the burning rate within a combustion chamber of an internal combustion engine.

It is another object of this invention that such a spark plug have an integrally formed prechamber from which the jet emanates, wherein the prechamber is provided with internal electrodes for igniting an air/fuel mixture within the prechamber.

It is a further object of this invention that such a method involve the forming of an internal electrode on the internal surface of the prechamber, the internal electrode being formed so as to be substantially embedded in and integral with the internal surface of the prechamber, so as to promote the durability of the internal electrode.

It is yet another object of this invention that such a method be relatively uncomplicated and necessitates a minimal number of operations, so as to enhance the manufacturability of the spark plug.

In accordance with a preferred embodiment of this invention, these and other objects and advantages are accomplished as follows.

According to the present invention, there is provided a method for forming a torch jet spark plug suitable for use in a torch jet-assisted spark ignition system for an internal combustion engine. The torch jet spark plug is configured to ignite a fuel mixture within a combustion prechamber formed integrally within the insulator body of the spark plug, such that a jet emanates from the prechamber and projects into the main combustion chamber of the engine, so as to increase the burning rate within the main chamber. More particularly, the method involves forming an inner electrode integral with the internal surface of the combustion prechamber by integrating the molding process for the spark plug's insulator body with an inking process by which the inner electrode is formed. The method of this invention significantly facilitates the manufacture of a spark plug taught by U.S. patent application (Attorney Docket No. G-11389) to Durling et al., which teaches a spark plug that is resistant to pre-ignition and internal short circuits, yet has a relatively uncomplicated structure which is readily manufacturable.

As described above, the spark plug formed in accordance with this invention generally includes an insulator body in which a combustion prechamber is formed. The prechamber has an oppositely disposed pair of ends, with a center electrode projecting into one end of the prechamber, while an outer electrode is integrally formed with an orifice at the second end of the prechamber. An electrically conductive material is deposited on the internal longitudinal surface of the prechamber so as to form an inner electrode. The inner electrode can be formed as a stripe on the internal surface of the prechamber, or can be formed to cover nearly the entire longitudinal surface of the prechamber, so as to have a hollow or tubular shape. The inner electrode forms an inner radial spark gap with the center electrode, and is electrically interconnected with the outer electrode. In accordance with the above structure, the inner spark gap is axially spaced from the orifice.

In accordance with the method of this invention, the inner electrode is formed using an integrated molding and inking process. The method generally involves the application of a metal ink to an outer surface of an elongate mandrel such that the metal ink forms a coating on the mandrel. The longitudinal length of the coating on the mandrel is substantially equal to the desired longitudinal length of the inner electrode formed on the surface of the prechamber. The mandrel is then inserted into a suitable mold, and the mold is filled with a substantially dry ceramic powder such that the powder envelops the coating on the mandrel. The dry ceramic powder is then compacted so as to densify the dry ceramic powder and thereby form a "green" ceramic blank. In doing so, the metal ink impregnates the dry ceramic powder which immediately surrounds the coating.

After compaction, the mandrel is removed from the ceramic blank, leaving a longitudinal cavity within the ceramic blank. As the mandrel is removed, the metal ink remains on the impregnated powder so as to form a metal-impregnated internal longitudinal surface within the ceramic blank. Thereafter, the blank is fired so as to form the insulator body of the spark plug. A portion of the internal longitudinal surface of the ceramic blank defines the combustion prechamber, such that the metal-impregnated surface of the ceramic blank forms the inner electrode of the combustion prechamber.

From the above, it can be seen that the method of this invention enables the manufacture of a spark plug which embodies the advantageous structure taught by Durling et al., yet involves a relatively uncomplicated process by which a metal ink is deposited during the molding of the insulator body. As a result, the complications associated with a separate step for depositing the metal ink within the prechamber of the insulator body are avoided. Furthermore, only a single heating step is required for the insulator body. During that heating step, the ceramic blank is fired to sinter the insulator body and the carrier component of the metal ink is dissipated to yield a continuous metal layer integral with the internal surface of the prechamber. Accordingly, the method of this invention is relatively uncomplicated and necessitates a minimal number of operations, so as to be highly suitable for use in the mass production of torch jet spark plugs for an internal combustion engine.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings wherein.

FIGS. *2a* through *2e* illustrate the integrated molding and inking process in accordance with a preferred embodiment of this invention.

DETAILED DESCRIPTION OF THE INVENTION

Figure 1:
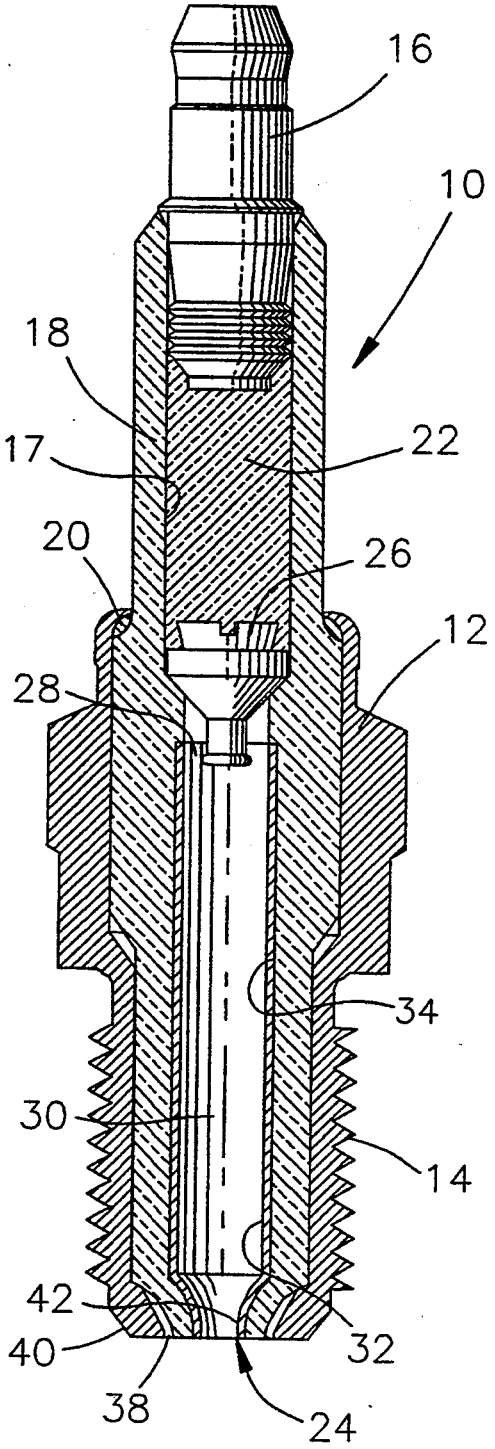
FIG. 1 shows a cross-sectional side view of a torch jet spark plug for which the method of this invention is particularly suited.

The present invention provides a method for forming a torch jet spark plug which is adapted for use in a torch jet-assisted spark ignition system for an internal combustion engine. As with torch jet spark plugs known in the prior art, the torch jet spark plug formed in accordance with this invention serves to increase the burning rate of an air/fuel mixture within a combustion chamber of an internal combustion engine by igniting an air/fuel mixture within a combustion prechamber which is associated with the spark plug. FIG. 1 depicts a preferred configuration for a torch jet spark plug 10 formed in accordance with this invention. The spark plug 10 is generally of the type disclosed in copending U.S. patent application (Attorney Docket No. G-11389) to Durling et al.

As with spark plugs typically used with internal combustion engines, the spark plug 10 includes a shell 12 formed from a steel, such as SAE 1008. External threads 14 are formed at one end of the shell 12 for the purpose of installing the spark plug 10 into a threaded hole in a wall of a combustion chamber within an internal combustion engine (not shown). An insulator body 18 formed from a ceramic material, such as alumina ($Al_2O_3$), is secured within the shell 12 in any suitable manner, such as by crimping as shown. A gasket 20 of a suitable temperature resistant material, such as copper or a soft steel, is provided between the shell 12 and the insulator body 18 to create a gas tight seal therebetween. The insulator body 18 projects through the end of the shell 12 opposite the threads 14. The portion of the body 18 which projects from the shell 12 has a passage 17 which receives an upper terminal 16, by which an electric current can be supplied to the spark plug 10. Located at the end of the spark plug 10 opposite the upper terminal 16 is a ground terminal 40. As shown, the ground terminal 40 is composed of a metal rim which extends radially inward from the shell 12, allowing the shell 12 to conduct electric current to the engine block. Those skilled in the art will recognize that the method of this invention is not dependent on the configuration of the ground terminal 40, and that various configurations could be utilized other than that shown in the Figures.

An electric current introduced at the upper terminal 16 is conducted to the ground terminal 40 through a resistor material 22 disposed in the passage 17 in the insulator body 18 and a series of intermediate electrodes disposed in a chamber, or prechamber 30, formed within the insulator body 18. As is conventional, the resistor material 22 is preferably a glass seal resistor material which provides electromagnetic interference suppression while also effectively sealing the passage 17 from the prechamber 30. The series of electrodes include a center electrode 26 which projects into the prechamber 30 from the passage 17, an inner electrode 34 which is disposed on and is integral with the internal surface 32 of the prechamber 30, and an outer, hollow electrode 24 formed at a via hole, or orifice 42, in the prechamber 30. The prechamber 30 is preferably elongated and extends along the longitudinal axis of the insulator body 18, such that the center electrode 26 projects into an upper end of the prechamber 30 while the orifice 42 is disposed at a lower end. The orifice 42 serves to vent the prechamber 30 to the main combustion chamber of an engine in which the spark plug 10 is installed. The orifice 42 is located on the longitudinal axis of the insulator body 18 so as to maintain the symmetry of the insulator body 18 and thereby enable its forming using the method of this invention.

According to a preferred aspect of this invention, the inner electrode 34 and the hollow electrode 24 are integrally formed by impregnating a metal ink into the internal surface 32 of the prechamber 30 while the insulator body 18 is being compacted and prior to firing. During firing, the carrier component of the metal ink is dissipated, and the metal component becomes an integral part of the internal surface 32 of the prechamber 30 to form a cermet layer. The thickness of the cermet layer may vary significantly, though a thickness of about 0.04 to about 0.2 millimeters has been found to be adequate. Most preferably, the metal component is a catalytically-active conductive material, such as a platinum or palladium alloy metal paste. As such, precombustion chemical reactions are promoted during engine compression which enhance the ignitability of the air/fuel mixture within the prechamber 30. Accordingly, less electrical spark energy is required to burn the air/fuel mixture within the prechamber 30.

As shown in FIG. 1, the cermet layer is embedded in nearly the entire internal surface 32 of the prechamber 30 and in the walls of the orifice 42, such that the inner electrode 34 and the hollow electrode 24 have tubular or hollow shapes. Alternatively, the inner electrode 34 could be formed as one or more stripes which extend longitudinally along the internal surface 32 of the prechamber 30. With either approach, an important aspect of this invention is realized in that the inner electrode 34 and the hollow electrode 24 are formed integrally with the prechamber 30 and the orifice 42, respectively. Forming the inner electrode 34 and hollow electrode 24 in this manner is advantageous in that it reduces the complexity of the spark plug 10 by eliminating the requirement for two or more discrete components which must be assembled with the insulator body 18. Also, because the metal which forms the inner electrode 34 and the hollow electrode 24 is not a coating, but is literally integral with the ceramic material which forms the insulator body 18, prechamber 30 and orifice 42, erosion of the inner electrode 34 and the hollow electrode 24 by the hot, high velocity gases flowing through the orifice 42 is prevented.

The inner electrode 34 does not electrically contact the center electrode 26, but forms a radial gap therewith. The radial gap defines an inner spark gap 28 across which an electric spark can jump for the purpose of igniting an air/fuel mixture within the prechamber 30. Because the inner electrode 34 completely circumscribes the center electrode 26, the inner spark gap 28 is generally annular-shaped. An outer spark gap 38 is formed between the hollow terminal 24 and the ground terminal 40. As shown, the ground terminal 40 is radially aligned with the hollow terminal 24 such that the outer spark gap 38 consists of a number of radial gaps across which an electric spark can jump to ignite an air/fuel mixture, though numerous other ground terminal designs could foreseeably be used which form more conventional axial spark gaps. Upon charging the prechamber 30 with a suitable air/fuel mixture from an engine's main combustion chamber during a compression stroke, an electric current supplied to the spark plug 10 via the upper terminal 16 will generate an electric spark at the inner spark gap 28, which will ignite the air/fuel mixture within the prechamber 30. Thereafter, the electric current will be conducted through the inner electrode 34 to the hollow electrode 24, where a second spark will be generated at the outer spark gap 38 to ignite the air/fuel mixture within the main combustion chamber. Though combustion proceeds relatively simultaneously in both the prechamber 30 and the main chamber, the small relative volume of the prechamber 30 results in a high pressure being developed within the prechamber 30 while the pressure within the main combustion chamber is still relatively low. As a result, a jet composed initially of an unburned portion of the air/fuel mixture will shoot from the prechamber 30. This jet passes near or through the burning mixture ignited by the outer spark gap 38, and is itself ignited. The jet then travels far into the main chamber, thereby significantly increasing the combustion rate within the main chamber.

In the embodiment shown where the inner electrode 34 is formed on substantially the entire internal surface 32 of the prechamber 30, an electrical capacitor is effectively formed. Consequently, the electric sparks which occur at the inner spark gap 28 and the outer spark gap 38 will fire sequentially rather than simultaneously, so as to enhance the torch jet effect while also reducing the peak voltage levels required to fire the spark plug 10. Accordingly, the electrical demands placed on the ignition coil and wiring will also be reduced.

From the above, it can be appreciated that the hollow electrode 24 serves two distinct functions. First, the hollow electrode 24 acts as an extension of the inner electrode 34 to form one electrode of the outer spark gap 38. Secondly, the hollow electrode 24 defines the orifice 42 necessary for the intake of the air/fuel mixture during the compression stroke as well as the expulsion of the combustion gases upon ignition of the air/fuel mixture within the prechamber 30. Advantageously, combining the physical features which form the spark plug's lower electrode and orifice in the manner shown in FIG. 1 makes possible the method of this invention, which is illustrated in FIGS. 2*a* through 2*e*.

Figure 2A:
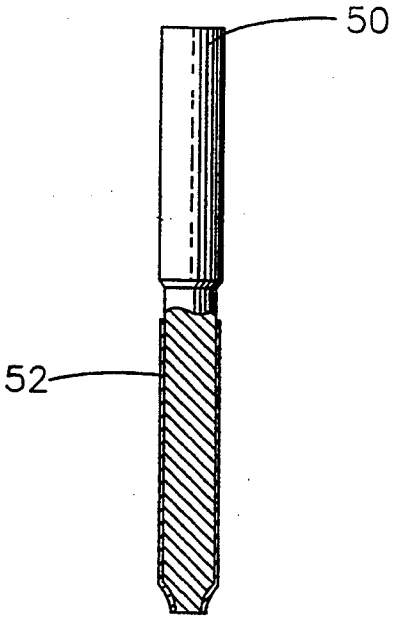

FIG. 2*a* illustrates a first step in the method of this invention, wherein a tapered end portion of a press mandrel 50 has been coated with a metal ink 52. The metal ink 52 is preferably composed of a catalytically-active metal, such as a platinum or palladium alloy, which is suspended in a suitable carrier, such as terpineol, although other suitable carriers may also be used. A suitable metal ink composition is identified as M297U, and available from the Englehard Corporation. Generally, the M297U composition is composed of about 75 percent solids of a 98% platinum/2% rhodium alloy, with the remaining 25 percent consisting essentially of an appropriate carrier. Preferably, the metal ink 52 is deposited to a thickness of about 0.1 to about 0.3 millimeters on the mandrel 50 using any suitable deposition process, including various spraying, rolling and dipping techniques. Prior to deposition, the mandrel 50 should be cleaned thoroughly to remove contaminants. After the deposition process, the mandrel 50 is preferably used immediately, in that the metal ink 52 will not transfer well if allowed to dry.

Figure 2B:
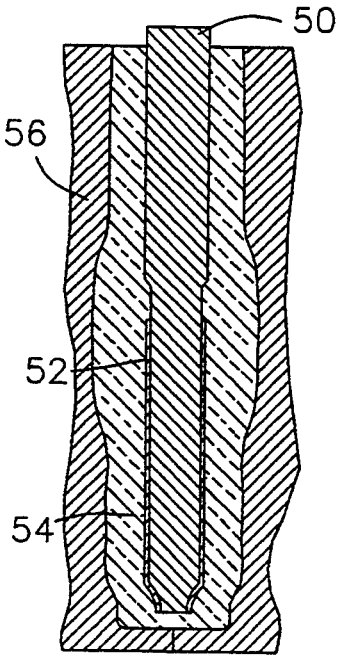

As shown in FIG. 2*b*, the mandrel 50 is then placed within a mold 56, and the mold 56 is then filled with a spray dried ceramic powder 54, such as an alumina powder. FIG. 2*b* shows the powder 54 undergoing isostatic pressing so as to compact and densify the powder 54. A suitable pressure and duration for this step appears to be about 3500 to about 10,000 psi for a duration of about 0.5 to about 5 seconds, though it is foreseeable that these pressures and durations could be varied widely and still achieve suitable results. The compaction process imparts an outer contour 58 to the compacted powder 54 which defines the shape of the resulting green ceramic blank 60 shown in FIG. 2*c*. In addition, the compaction process causes the metal ink 52 on the mandrel 50 to impregnate the powder 54 immediately surrounding the mandrel 50, so as to form a cermet layer 68.

Figure 2C:
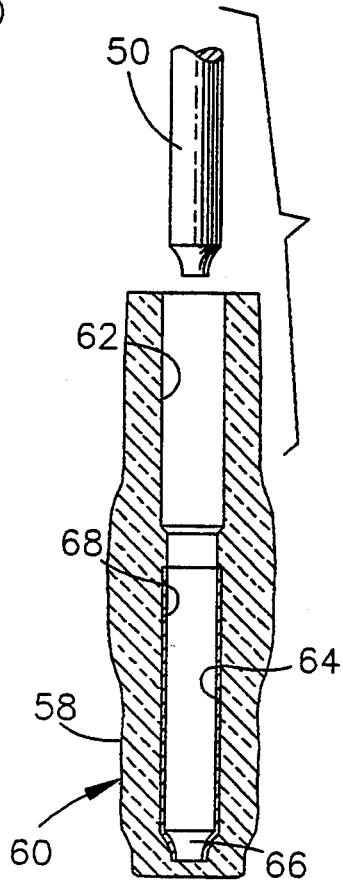

After the pressure is released, the solidified blank 60 is removed from the mold 56, and the blank 60 is removed from the mandrel 50, as indicated in FIG. 2*c*. In practice, the mandrel 50 has been found to remove easily from the blank 60, with the metal ink 52 being cleanly and completely transferred from the mandrel 50. As a result of the preferred shape of the mandrel 50, the blank 60 is characterized by having a bore with a first portion 62 contiguous with the exterior of the blank 60, a smaller diameter portion 64 extending from the first portion 62 further into the blank 60, and finally terminates with a reduced portion 66. Only the smaller diameter portion 64 and the reduced portion 66 include the metal-impregnated layer 68, as shown in FIG. 2*c*, in that the prechamber 30 of the spark plug 10 is defined by these portions of the bore in the blank 60.

Figure 2D:
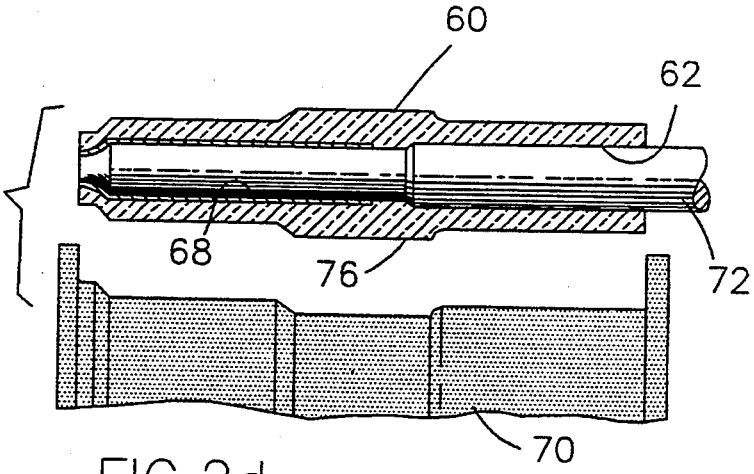

FIG. 2*d* illustrates the next preferred processing step in accordance with this invention, in which the contour 58 of the blank 60 is ground to achieve the desired final contour 76 of the insulator body 18. A grinding spindle 72 may be used to support the blank 60. As is conventional, an appropriately contoured grinding wheel 70 is then engaged with the contour 58 of the blank 60 for the purpose of achieving the final contour 76 of the insulator body 18, taking into consideration shrinkage which will occur during the subsequent firing operation.

Figure 2E:
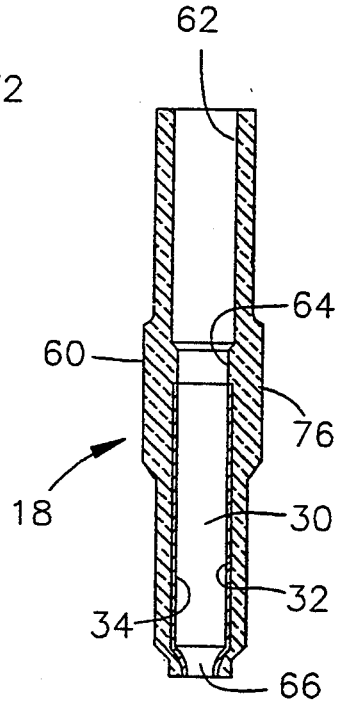

The blank 60 is then fired at a temperature and for a duration which is sufficient to densify the blank 60. As those skilled in the art will realize, a suitable temperature and duration will depend on the material from which the blank 60 is formed. FIG. 2*e* illustrates the finished insulator body 18 after firing the blank 60. The insulator body 18 retains the bore formed in the blank 60, which now corresponds to the features of the spark plug 10 illustrated in FIG. 1. Specifically, the first portion 62 of the bore forms the passage 17 in the upper end of the insulator body 18, the smaller diameter portion 64 defines the prechamber 30, and the reduced portion 66 defines the orifice 42. Importantly, the carrier component of the metal-impregnated layer 68 has been dissipated during the firing operation, leaving only the metal component of the metal ink 52 to form the inner electrode 34.

In that the metal component of the metal ink 52 is embedded in the ceramic substrate formed by the internal surface 32 of the prechamber 30, the inner electrode 34 does not exist as a layer on the internal surface 32, but now actually defines the internal surface 32. Therefore, the thickness of the inner electrode 34 is more accurately described as the depth to which the metal component of the metal ink 52 has impregnated the powder 54. In practice, it has been determined that metal has penetrated to maximum depths of about 0.2 millimeters, with an average depth of about 0.1 millimeters. Advantageously, the significant penetration of the metal ink 52 achieved in accordance with this invention improves the adhesion of the metal to the ceramic substrate and the erosion resistance of the hollow and inner electrodes 24 and 34, as well as the overall durability of the hollow and inner electrodes 24 and 34 and the spark plug 10.

Figure 3:
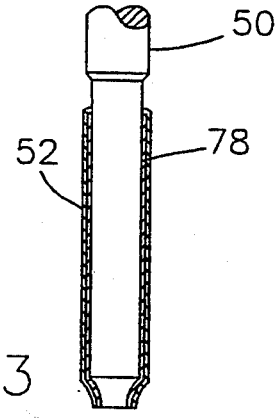
FIG. 3 shows a cross-sectional side view of a mandrel on whose surface multiple layers of alumina and metal inks have been deposited in accordance with a second embodiment of this invention.

FIG. 3 illustrates a second embodiment of this invention which entails first coating the mandrel 50 with a ceramic ink 78 that is preferably composed of alumina which has been suspended in a suitable carrier, such as terpineol. The metal ink 52 is then applied as shown to achieve a multilayer transfer. As a result, the internal surface 32 of the insulator body 18 includes a protective alumina coating over all but the extreme upper edge of the inner electrode 34, so as not to interfere with the spark gap formed by the inner electrode 34 and the center electrode 26. The protective alumina coating serves to increase the erosion resistance to the hot and abrasive gas flow within the prechamber 30 during the operation of the spark plug 10.

A variation of this technique is particularly suited where the metal ink 52 is composed of the preferred catalytically-active platinum or palladium alloys. By selectively depositing the ceramic ink 78 on the mandrel 50, certain portions of the inner electrode 34 can be masked by the resulting alumina coating. The advantage of this approach is that the degree of catalytic activity of the inner electrode 34 can be tailored to achieve a desired level of precombustion chemical reactions during engine compression which, as noted before, can be advantageously utilized to enhance the ignitability of the air/fuel mixture within the prechamber 30.

Finally, additional layers of ceramic ink 78 and metal ink 52 can be utilized if desired. As noted previously, the hollow shape of the inner electrode 34 enables the inner electrode 34 to perform as a capacitor in parallel with the outer spark gap 38. As a result, the electric sparks which occur at the inner spark gap 28 and the outer spark gap 38 will fire sequentially rather than simultaneously, so as to reduce the peak voltage levels required to fire the spark plug 10, so as to reduce the electrical demands placed on the ignition coil and wiring system.

From the above, it can be seen that a primary feature of the spark plug 10 formed in accordance with the method of this invention, is that the spark plug is able to enhance the burning rate within engine's main combustion chamber. Specifically, the jet created by the spark plug 10 increases the turbulence within the main combustion chamber, as well as presents a larger flame front area within the main combustion chamber. As a result of a faster burning rate, lower cyclic variation in cylinder pressure is achieved, which enables a higher engine efficiency by utilizing a higher compression ratio. Such a capability is advantageous for enhancing engine power and retaining satisfactory fuel economy. Other performance-related advantages include improved idle stability and knock resistance under high loads at low engine speeds.

A significant advantage of the method of this invention is that the method enables the manufacture of the spark plug 10 which embodies the advantageous structure noted above, and as taught by U.S. patent application (Attorney Docket No. G-11389) to Durling et al. More specifically, the method of this invention involves a relatively uncomplicated process by which a metal ink 52 is readily deposited during the molding of the insulator body 18. As a result, the complications associated with a separate step for forming the inner electrode 34, such as by depositing a metal ink within the prechamber 30 of the insulator body 18, is completely avoided. Furthermore, by introducing the metal ink 52 prior to molding, the metal ink 52 is effectively impregnated into the ceramic powder 54 which forms the insulator body 18, such that the inner electrode 34 is an integral part of the insulator body 18.

Another significant advantage of this invention is that only a single firing operation is required to form the insulator body 18, during which the ceramic blank 60 is fired to form the insulator body 18 and the carrier component of the metal ink 52 is dissipated to yield a continuous metal layer which is embedded into the internal surface 32 of the prechamber 30. Accordingly, the method of this invention is relatively uncomplicated and requires a minimal number of operations, so as to be highly suitable for use in the mass production of torch jet spark plugs for internal combustion engines.

While our invention has been described in terms of a preferred embodiment, it is apparent that other forms could be adopted by one skilled in the art—for example, by substituting appropriate materials or modifying the geometry or construction of the components with which this invention is carried out. Accordingly, the scope of our invention is to be limited only by the following claims.

The embodiments of the invention in which an exclusive property or privilege is claimed are defined as follows:

1. A method for forming an electrode on a longitudinal surface of a combustion prechamber within a torch jet spark plug, the method comprising the steps of:

applying a metal ink composition to an outer surface of an elongate mandrel such that said metal ink composition forms a coating on said mandrel, the longitudinal length of said coating on said mandrel being substantially equal to the length of said electrode;

inserting said mandrel into a mold;

filling said mold with a substantially dry ceramic powder;

compacting said dry ceramic powder around said mandrel such that said metal ink composition impregnates a proximate portion of said dry ceramic powder, and such that said dry ceramic powder is densified so as to form a ceramic blank;

removing said mandrel from said blank such that said metal ink composition forms a metal-impregnated longitudinal surface of said combustion prechamber; and firing said blank so as to form a spark plug insulator body comprising said combustion prechamber, such that said metal-impregnated longitudinal surface of said combustion prechamber forms said electrode.

2. A method as recited in claim 1 wherein said metal ink composition comprises a platinum alloy.

3. A method as recited in claim 1 wherein said applying step includes coating said outer surface of said mandrel with said metal ink composition such that said metal-impregnated longitudinal surface is continuous along a perimeter of said combustion prechamber.

4. A method as recited in claim 1 further comprising the step of forming a capacitor with said metal-impregnated longitudinal surface of said combustion prechamber.

5. A method as recited in claim 1 wherein said metal ink composition comprises a catalytically-active alloy, such that said metal-impregnated longitudinal surface promotes precombustion chemical reactions within said combustion prechamber.

6. A method as recited in claim 1 further comprising the step of applying a ceramic ink composition to said outer surface of said mandrel prior to applying said metal ink composition to said mandrel, wherein said ceramic ink composition forms an erosion-resistant ceramic layer which overlays said metal-impregnated longitudinal surface of said combustion prechamber.

7. A method as recited in claim 5 wherein said step of applying said ceramic ink composition is performed such that said ceramic layer selectively masks said metal-impregnated longitudinal surface on said combustion prechamber so as to affect the degree of catalytic activity of said metal-impregnated longitudinal surface.

8. A method for forming a catalytically-active electrode on a longitudinal surface of an elongate combustion prechamber which is oriented longitudinally within an insulator body of a torch jet spark plug, the method comprising the steps of:

applying an ink composition to an outer surface of an elongate mandrel such that said metal ink composition forms a coating on said mandrel, the longitudinal length of said coating on said mandrel being substantially equal to the length of said catalytically-active electrode, said ink composition comprising a catalytically-active conductive material;

inserting said mandrel into a mold;

filling said mold with a substantially dry ceramic powder such that said dry ceramic powder envelops said coating on said mandrel;

compacting said dry ceramic powder such that said metal ink composition impregnates a proximate portion of said dry ceramic powder, and such that said dry ceramic powder is densified so as to form a ceramic blank;

removing said mandrel from said blank such that said metal ink composition forms a metal-impregnated longitudinal surface of said combustion prechamber;

grinding said blank; and firing said blank so as to form said insulator body comprising said combustion prechamber, such that said metal-impregnated longitudinal surface of said combustion prechamber forms said catalytically-active electrode which promotes precombustion chemical reactions within said combustion prechamber.

9. A method as recited in claim 8 wherein said ink composition comprises a platinum alloy.

10. A method as recited in claim 8 wherein said applying step includes coating said outer surface of said mandrel with said ink composition such that said metal-impregnated longitudinal surface is continuous along a perimeter of said combustion prechamber.

11. A method as recited in claim 8 further comprising the step of forming a capacitor with said catalytically-active electrode.

12. A method as recited in claim 8 further comprising the step of grinding said blank after said removing step so as to establish the contour of said insulator body on said blank.

13. A method as recited in claim 8 further comprising the step of applying an alumina ink composition to said outer surface of said mandrel prior to applying said ink composition to said mandrel, wherein said alumina ink composition forms an erosion-resistant alumina layer which overlays said metal-impregnated longitudinal surface of said combustion prechamber.

14. A method as recited in claim 13 wherein said step of applying said alumina ink composition is performed such that said alumina layer selectively masks said metal-impregnated longitudinal surface on said combustion prechamber so as to affect the degree of catalytic activity of said catalytically-active electrode.

15. A method for forming a hollow catalytically-active electrode on a longitudinal surface of an elongate combustion prechamber which is oriented longitudinally within an insulator body of a torch jet spark plug, the method comprising the steps of:

applying a metal ink composition to an outer surface of an elongate mandrel such that said metal ink composition forms a coating on said mandrel, the longitudinal length of said coating on said mandrel being substantially equal to the length of said hollow catalytically-active electrode, said metal ink composition comprising a catalytically-active conductive material;

inserting said mandrel into a mold;

filling said mold with a substantially dry ceramic powder such that said dry ceramic powder envelops said coating on said mandrel;

compacting said dry ceramic powder such that said metal ink composition impregnates a proximate portion of said dry ceramic powder, and such that said dry ceramic powder is densified so as to form a ceramic blank;

removing said mandrel from said blank such that said metal ink composition forms a metal-impregnated longitudinal surface which is continuous along a perimeter of said combustion prechamber;

grinding said blank so as to establish the contour of said insulator body on said blank; and firing said blank so as to form said insulator body comprising said combustion prechamber, such that said metal-impregnated longitudinal surface of said combustion prechamber forms said hollow catalytically-active electrode which promotes pre-combustion chemical reactions within said combustion prechamber.

16. A method as recited in claim 15 wherein said metal ink composition comprises a platinum alloy.

17. A method as recited in claim 15 further comprising the step of applying an alumina ink composition to said outer surface of said mandrel prior to applying said metal ink composition to said mandrel, wherein said alumina ink composition forms an erosion-resistant alumina layer which overlays said metal-impregnated longitudinal surface of said combustion prechamber.

18. A method as recited in claim 17 wherein said step of applying said alumina ink composition is performed such that said alumina layer selectively masks said metal-impregnated longitudinal surface on said combustion prechamber so as to affect the degree of catalytic activity of said hollow catalytically-active electrode.

* * * * *